US010912427B1

(12) United States Patent
Szajnert

(10) Patent No.: US 10,912,427 B1
(45) Date of Patent: Feb. 9, 2021

(54) COMBINED TOOTHPASTE TUBE AND ADDITIONAL ITEM HOLDER

(71) Applicant: Carlos Szajnert, Miramar, FL (US)

(72) Inventor: Carlos Szajnert, Miramar, FL (US)

( * ) Notice: Subject to any disclaimer, the term of this patent is extended or adjusted under 35 U.S.C. 154(b) by 0 days.

(21) Appl. No.: 16/429,714

(22) Filed: Jun. 3, 2019

Related U.S. Application Data

(60) Provisional application No. 62/680,105, filed on Jun. 4, 2018.

(51) Int. Cl.
*A47K 5/18* (2006.01)
*A61J 1/03* (2006.01)

(52) U.S. Cl.
CPC ..... *A47K 5/18* (2013.01); *A61J 1/035* (2013.01)

(58) Field of Classification Search
CPC . A47K 1/09; A47K 5/18; B65D 35/24; B65D 35/34; B65D 35/56; B65D 35/565; A61J 1/035
USPC ..... 222/192, 173, 93, 100
See application file for complete search history.

(56) References Cited

U.S. PATENT DOCUMENTS 1,973,390 A * 9/1934 Plants ..... A47K 1/09 368/93
3,143,152 A * 8/1964 Knable ..... A46B 11/0006 141/360
3,525,457 A * 8/1970 Hausmann ..... B65D 35/34 222/100
3,885,708 A * 5/1975 Parry ..... B65D 35/34 222/100
4,301,945 A * 11/1981 Dworkin ..... B65D 35/34 222/100
4,576,314 A * 3/1986 Elias ..... B65D 35/32 222/103
2015/0274376 A1* 10/2015 Weber ..... B65D 35/34 222/100

* cited by examiner

*Primary Examiner* — Donnell A Long
(74) *Attorney, Agent, or Firm* — John Rizvi; John Rizvi, P.A.-The Patent Professor®

(57) ABSTRACT

A combined toothpaste tube and additional item (e.g., a medicine package) holder includes a body having a base and first and second walls extending upwards, in parallel, from the base forming a slot in communication with a channel. Top edges of the walls flare outwards away from each other to form resilient, convex tube compression members that face each other within the slot. A key having a handle and a shaft is provided within the channel to wind a bottom end of a collapsible tube of toothpaste disposed between the compression members within the slot. As the handle of the key is rotated, the bottom end of the tube is wound onto the shaft allowing the compression members to engage the outer surface of the tube to dispense toothpaste from the top opening of the tube. At least one spring clip is attached to the base of the holder for retaining and displaying an item, such as a medicine package.

18 Claims, 6 Drawing Sheets

COMBINED TOOTHPASTE TUBE AND ADDITIONAL ITEM HOLDER

CROSS-REFERENCE TO RELATED APPLICATIONS

This application is a Non-Provisional Patent Application that claims the benefit of Provisional Patent Application Ser. No. 62/680,105, filed Jun. 4, 2018, which is incorporated by reference herein in its entirety.

FIELD OF THE INVENTION

The present invention relates generally to bathroom accessories, and more particularly, to a device to dispense toothpaste and simultaneously display items, such as packets of medicine in a position to serve as a reminder to take the medicine.

BACKGROUND OF THE INVENTION

Individual daily morning or evening bathroom routines often involves performing multiple tasks. Some of these tasks include showering or washing, shaving, cleaning and/or brushing their teeth. Additionally, many individuals keep medications, that are required to be taken on a routine or prescribed basis, in the bathroom since the individual is relatively sure to be in there at the appropriate or requisite times for taking the medications, i.e., morning and evenings.

Brushing one's teeth typically involves handling a tube of toothpaste and manipulating the tube to dispense the toothpaste from within. As can be appreciated, the bathroom setting can be a wet and slippery place, especially after washing with soap and water. The tubes of toothpaste are often formed from a plastic or polymer material rendering them slippery and difficult to handle when wet or when a user's hands are wet, complicating the process of dispensing the paste from within the tube. Furthermore, tubes are often difficult to empty in their entirety, and toothpaste often remains within the tube when the tube is discarded.

Additionally, many bathrooms have limited counter space and often are cluttered with various items such as with tubes of toothpaste, toothbrushes, razors and cans of shaving cream, and soaps. This, along with the wet and slippery nature of a bathroom countertop, makes it inconvenient and difficult to find and manipulate the various items located thereon. The difficulty in locating medications among the cluttered items, can be particularly troublesome for medications that must be taken at prescribed times. Such medications are sometimes stored in medicine cabinets where they are easily forgotten. Alternatively, if the medicine packages are left out on the countertops, they can become wet and destroyed or easily overlooked among the many other items scattered across the bathroom countertop.

Accordingly, there is an established need for a solution to at least one of the aforementioned problems. For example, there remains a need for a convenient toothpaste tube holder and dispenser that maintains the tube of toothpaste in a readily visible and available position. There is also an established need for a convenient toothpaste tube holder that can hold packages of medication in a visibly, accessible position to remind users to take their medication while keeping the package of medication in a relatively dry condition and organized.

SUMMARY OF THE INVENTION

The present invention is directed to a convenient and useful combined toothpaste tube and additional item holder for holding and optionally dispensing toothpaste out of a tube of toothpaste, and for holding one or more items in a visible and readily available position. For example, the combined toothpaste tube and additional item holder may hold one or more packages of medicine in a highly visible position to serve as a reminder to take the medication contained within the one or more packages of medicine. The combined toothpaste tube and additional item holder includes a body having a base and first and second walls extending upwardly from the base. A key can be provided to receive a bottom end of the tube of toothpaste. The first and second walls define a slot for receipt of the tube of toothpaste. The slot includes a narrower, intermediate portion which is configured to retain or pinch the tube of toothpaste, and a wider, lower end or channel configured to house a wrapped or winded closed end of the tube of toothpaste. The key is inserted into the enlarged lower end or channel of the slot to rotate the bottom end of the tube of toothpaste within the channel. At least one spring clip for retaining and displaying an item such as a package of medication extends from the body.

One embodiment of the invention provides a combined toothpaste tube and item holder comprising: a body including a tube holder base having a planar bottom surface, a first sidewall, and a second sidewall each integrally joined to and extending upwards in parallel from the base forming a channel including a planar channel surface opposite the planar bottom surface and a slot in communication with the channel, each sidewall including a top end flaring outwards away from each other defining a convex formation, each convex formation extending towards each other within the slot forming tube compression members; a key having a handle attached to an elongate shaft readily rotated to wind a closed end of a collapsible tube where the key is removably inserted within the channel in which the elongate shaft rests on the planar channel surface in parallel with the slot; and at least one spring clip including a clip base having a first end attached to one side of the tube holder base and a second end conjoined to a clip wall, where the clip wall extends upwards at an incline from the second end towards an outer surface of one sidewall and terminating at a top wall edge and where the top wall edge is displaced adjacent the outer surface of the one sidewall for removably holding and displaying an item between the top edge and the outer surface of the one sidewall.

In one aspect, the first sidewall includes an outer arcuate surface beginning along a bottom edge of the tube holder base and terminating at a concave formation, and wherein the second sidewall includes an outer arcuate surface beginning along another bottom edge of the tube holder and terminating at a concave formation, with the concave formations being opposite the convex formation.

In another aspect, the tube compression members are spaced apart from each other a predetermined distance and are situated above the channel.

In yet another aspect, each sidewall resiliently flexes outwards away from each other greater than the predetermined distance when the collapsible tube is disposed between the tube compression members.

In another aspect, the handle is perpendicular to the elongate shaft and includes an outer handle surface engaging with outer side edges of each sidewall when the elongate shaft is removably disposed within the channel. The elongate shaft may include an elongate slot receiving the closed end of the collapsible tube therein.

In yet another aspect, the at least one spring clip includes another spring clip including a clip base having a first end attached to another side of the tube holder base and a second end conjoined to a clip wall where the clip wall extending upwards at an incline from the second end towards an outer surface of another sidewall and terminating at a top wall edge in which the top wall edge is the placed adjacent the outer surface of another sidewall for retaining and displaying another item.

In one aspect, the first end of each spring clip is integrally formed with the tube holder base such that an outer bottom surface of each clip base is coplanar with the planar bottom surface of the tube holder base. Each clip wall of the at least one spring clip and another spring clip resiliently flexes outwards from the one sidewall and the another sidewall along the second ends of the clip bases.

In yet another aspect, the first end of the at least one spring clip and another spring clip is attached about a central region of the tube holder base. The top wall edges of each spring clip bends outwards away from each outer surface of respective sidewalls forming a curved top edge.

In one aspect, the combined toothpaste tube and item holder further includes a support pad disposed on the planar channel surface within the channel. The elongate shaft of the key is removably disposed on the support pad.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient toothpaste dispenser and medicine display device for holding and dispensing toothpaste from a tube of toothpaste onto a toothbrush, and at least one medicine clip for removable holding one or more packages of medicine to remind a user of the need to take their medicine on a prescribed basis when using the dispenser, and for retaining the medicine in an organized manner within a bathroom.

Figure 1:
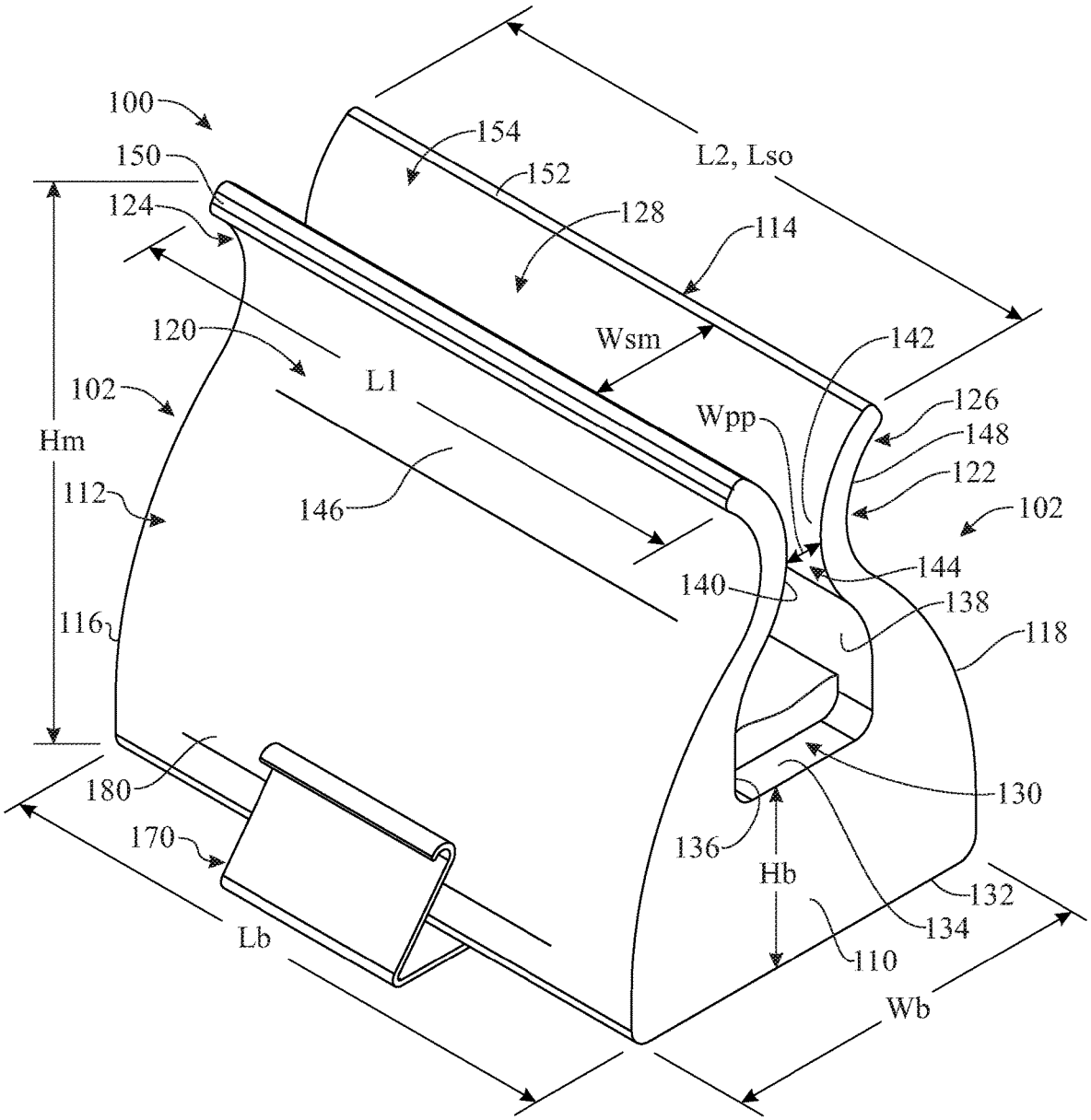
FIG. 1 presents a front, side isometric view of a combined toothpaste tube and additional item holder, in accordance with an embodiment of the present invention.
Figure 2:
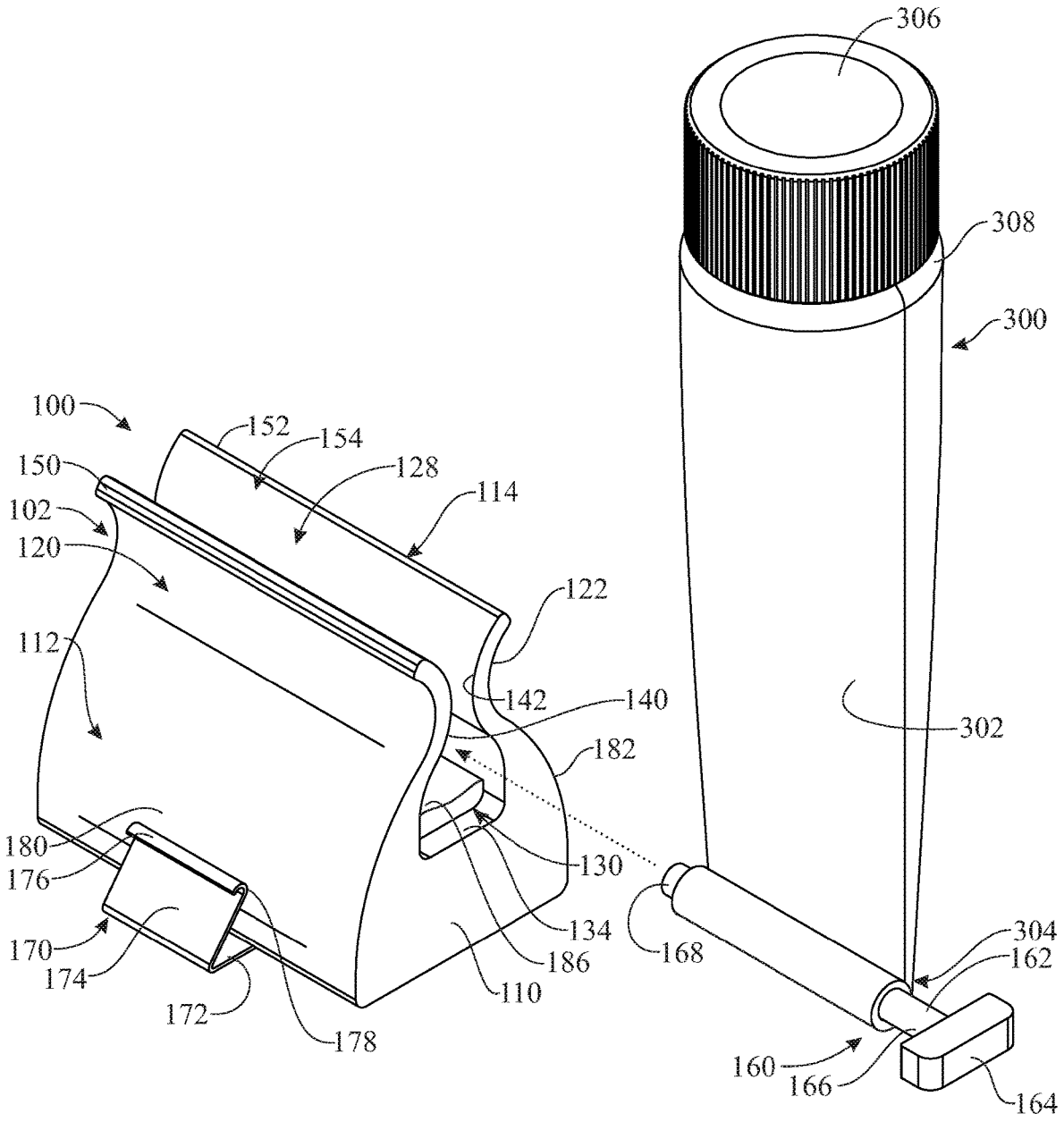
FIG. 2 presents a front, side isometric view of the combined toothpaste tube and additional item holder of FIG. 1 including a roller key in operative use with a tube of toothpaste, in accordance with the embodiment of the present invention.

Referring now to FIGS. 1 and 2, a combined toothpaste tube and additional item holder 100 is illustrated in accordance with an exemplary embodiment of the present invention, and configured as a monolithically formed dispenser with at least one clamp or clip, in accordance with one embodiment of the present invention. The combined toothpaste tube and additional item holder 100 comprises a body 102 which includes a generally rectangular base 110 and a pair of arms or walls, and more specifically, a first wall 112 and a second wall 114, extending or rising upwardly from the base 110. The first and second walls 112 and 114 include respective first and second lower portions 116 and 118 seamlessly extending or emerging upwardly from the base 110, first and second arcuate central portions 120 and 122 extending from the first and second lower portions 116 and 118 and curving inwardly and convexly towards each other. The first and second walls 112 and 114 further include respective first and second arcuate or recurving end portions 124 and 126 flaring concavely outwardly away from each other and extending from the first and second central portions 120 and 122. The first and second walls 112 and 114 define a slot 128 there between. The first and second lower portions 116 and 118 of the first and second walls 112 and 114 are spaced apart from one another and, together with the base 110, define an enlarged area or channel 130 for receipt of a tube of toothpaste 300 as described in more detail herein below.

As shown in FIG. 1, the base 110 is formed as a generally rectangular block having a length Lb and a width Wb. The base 110 has an approximate height Hb between a flat bottom surface 132 of the base and an inner top surface 134 of the base 110. The inner top surface 134 is generally flat and parallel to the flat bottom surface 132 and defines the lower extremity of the channel 130. While not specifically shown, the base 110 can, alternatively, be oval shaped, circular, etc. The combined toothpaste tube and additional item holder 100 has a maximum height Hm. The base 110 may comprise a solid mass having sufficient weight to support a tube of toothpaste in an upright, vertical position, or may include a chamber for enclosing a ballast such as metal pieces, sand, dense plastic, or other weighting element.

The first and second lower portions 116 and 118, of the first and second walls 112 and 114, define respective first and second inner sides 136, 138 of the channel 130. In order to retain or pinch a portion of the tube of toothpaste 300, the first and second arcuate central portions 120 and 122 curve inwardly towards each other to narrow the slot 128. The first and second arcuate central portions 120, 122 include respective inwardly-facing convex formations or convex inner surfaces 140, 142 that face each other to form tube compression members to engage the outer surface of the tube. The first and second inwardly facing convex inner surfaces 140 and 142 narrow or reduce the width of the slot 128 to form a pinch point or area 144 within the slot 128. The first and second arcuate central portions 120, 122 further include respective first and second concave outer surfaces 146, 148 opposite the first and second convex inner surfaces 140 and 142.

With continued reference to FIG. 1, the first and second recurving end portions 124 and 126 extend from the first and second arcuate central portions 120, 122 and terminate in first and second free ends 150 and 152, respectively. The first and second recurving end portions 124 and 126 and, more specifically, the first and second free ends 150 and 152, recurve or flare outwardly away from each other to define an enlarged opening 154 in the slot 128. The maximum width Wsm of the slot opening 154 is greater than the width Wpp of the pinch point or pinch area 144 located between the first and second convex inner surfaces 140, 142 of the first and second arcuate central portions 120, 122, respectively (see also FIG. 5). This narrowing of the slot 128 at the pinch point or pinch area 144 allows the first and second arcuate central portions 120 and 122 to grab or squeeze the tube of toothpaste 300 as described in more detail herein below. The slot opening 154 has a length Lso which is equal to the lengths L1 and L2 of the first and second walls 112 and 114 at the first and second free ends 150 and 152.

Referring now to FIG. 2, the combined toothpaste tube and additional item holder 100 is provided to assist in dispensing toothpaste (not shown) from the tube of toothpaste 300. The tube of toothpaste 300 generally includes a body portion 302 having a closed bottom end 304 and a removable cap 306 removably attached to an open top end 308 of the body portion 302. In order to retain a portion of the tube of toothpaste 300 within the channel 130 in the combined toothpaste tube and additional item holder 100, the combined toothpaste tube and additional item holder 100 further includes a key 160 having an elongated shaft 162 and a T-handle 164 located at a first end 166 of the elongated shaft 162. The shaft 162 has a second end 168 and may include a lengthwise slot (not shown) for receipt and retention of and a portion of the tube of toothpaste 300.

The combined toothpaste tube and additional item holder 100 additionally includes a first medicine clamp or clip 170 extending outwardly from the base 110. The first medicine clip 170 is provided to retain and display medicines, and to remind users to take their medication around the same time as undertaking their morning oral hygiene routine. The first medicine clip 170 includes a first clip base 172 extending outwardly from the base 110 such that the out surface of the base 172 is coplanar with the outer bottom surface of base 132. Clip 170 further includes a wall 174 extending upwardly from the first clip base 172 and inclined towards the first wall 112. The upwardly extending wall 174 terminates in a recurved free end 176 away from the first wall 112 forming a convex inner surface 178 to engage with, or butt against, a stored item including, but not limited to, a medicine pack. The convex inner surface 178 pushes the stored item towards a first side outer surface 180 of the first wall 112. While the first side outer surface 180 is described as part of the first wall 112, depending on the height of the first medicine clip 170, the first side outer surface 180 may alternatively or additionally be part of the base 110. The second wall 114 also has a second side outer surface 182 against which a second stored item, such as a package of medicine may additionally and/or alternatively be secured. The combined toothpaste tube and additional item holder 100 may additionally include a support pad 186 that is located in the bottom of the channel 30, on top of the inner top surface 134 of the base 110. The support pad 186 is employed to prevent the elongate shaft from rotating freely when a portion of the tube is wound around the shaft 162 and the shaft 162 operatively disposed within the channel 130 while the handle 164 is at rest. The support pad 186 can also be used to provide operations support to the key as well. The support pad 186 may comprise foam, rubber, fabric, plastic or any combination thereof.

The base 110 and the first and second side walls 112 and 114, respectively, may be formed as a monolithic or integral structure, or may be formed separately and connected by known methods such as, for example gluing, welding, mold injection, casting, etc. The base 110 and first and second side walls 112 and 114 can be formed from a variety of materials such that the first and second side walls 112 and 114 are flexible relative to the base 110 permitting the first and second side walls 112, 114 to elastically splay apart when the tube of toothpaste 300 is inserted there between, and can flex inwardly to compress the tube of toothpaste 300 when retained within the slot 128. The first medicine clip 170 may also be formed separately or integral with the base 110 and is formed of a material sufficiently flexible to retain a medicine pack between the convex inner surface 178 of the clip 170 and the first side outer surface 180 of the first wall 112.

Figure 3:
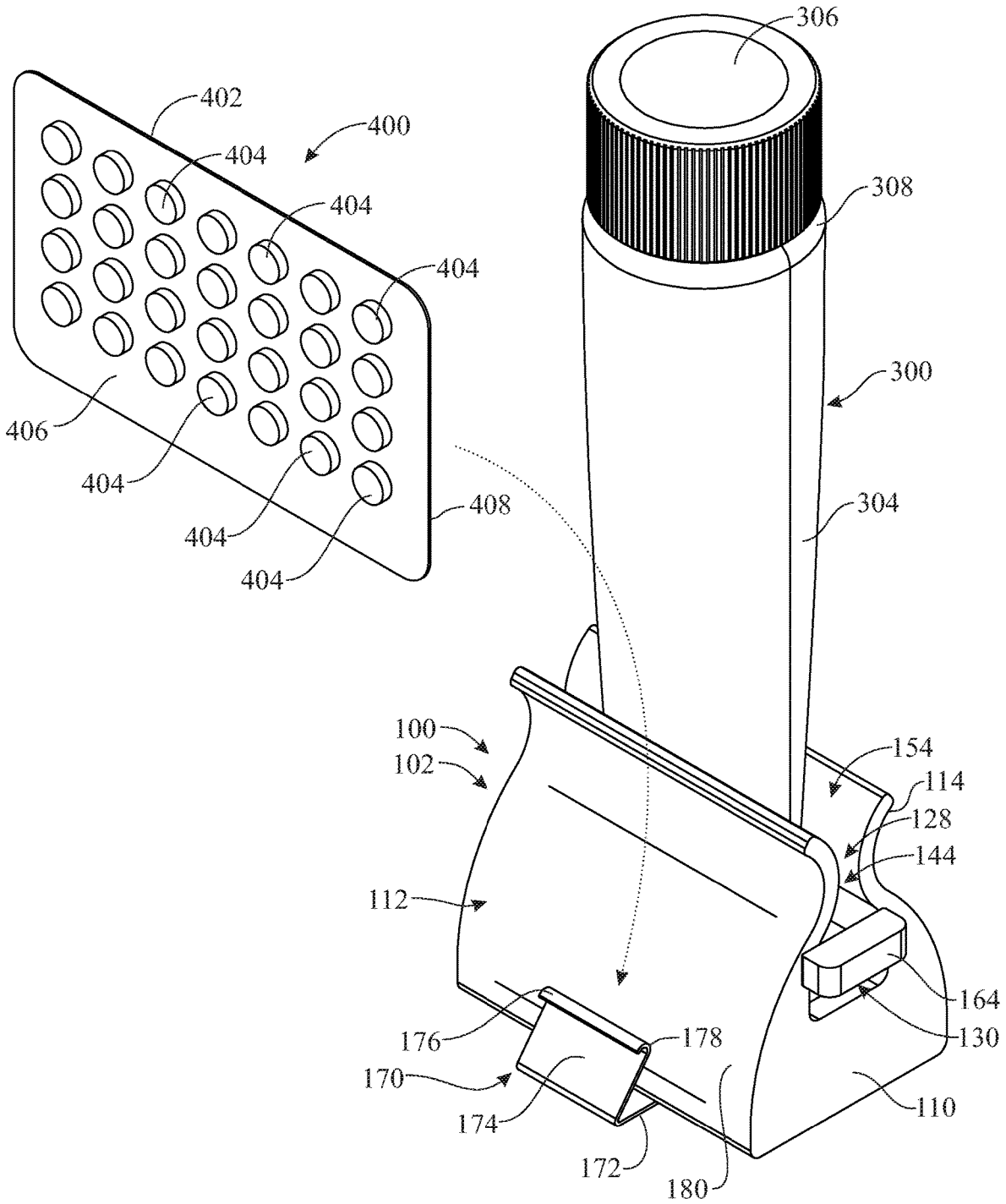
FIG. 3 presents a front, side isometric view of the combined toothpaste tube and additional item holder of FIG. 1, showing the holder retaining the tube of toothpaste, and a packet of medicine readily inserted into a medicine clip included on the combined toothpaste tube and additional item holder, in accordance with an embodiment of the present invention.
Figure 4:
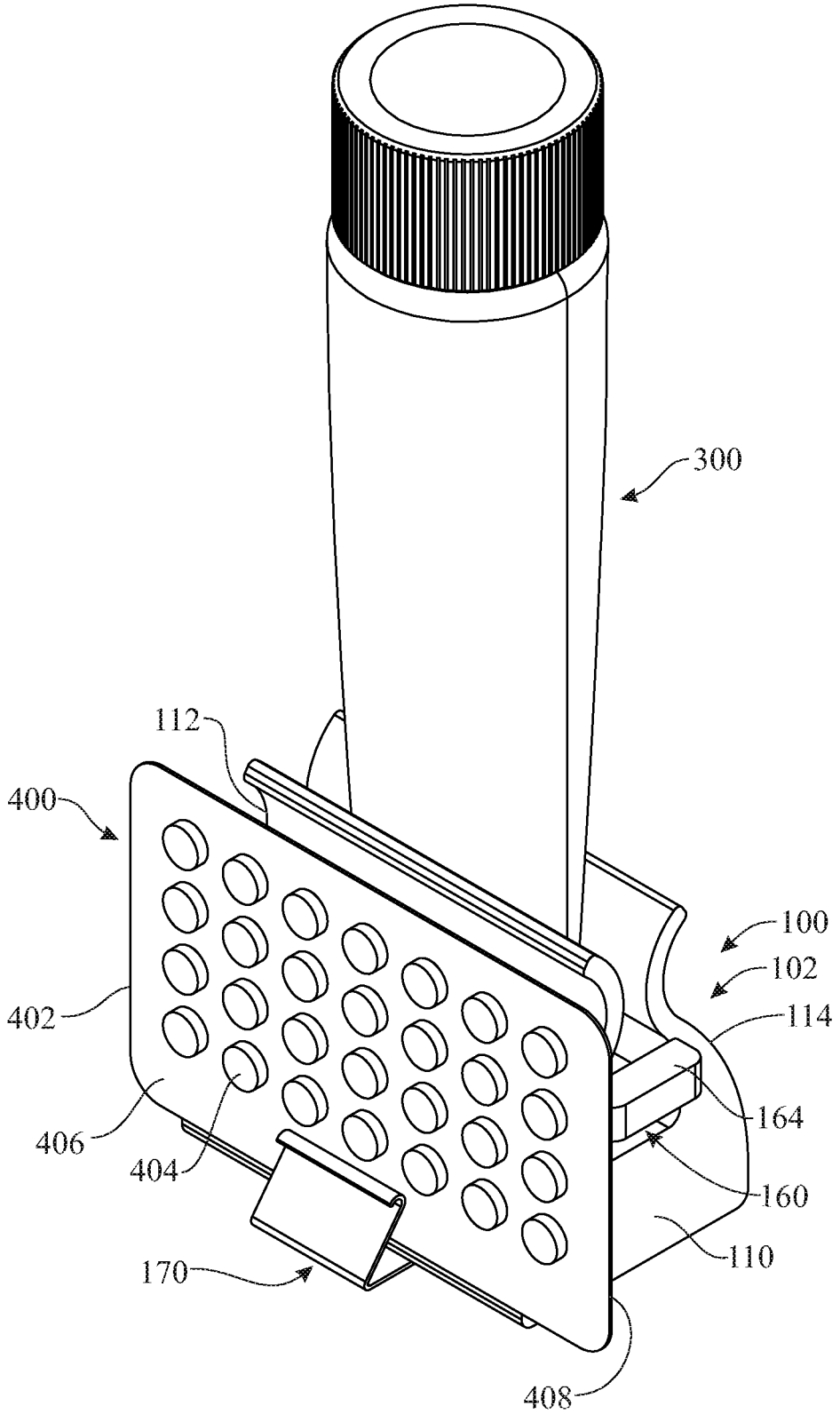
FIG. 4 presents a front, side isometric view of an assembled combined toothpaste tube and additional item holder of FIG. 1, showing the tube of toothpaste within the holder, and a package of medicine removable stored within the medicine clip, in accordance with an embodiment of the present invention.
Figure 5:
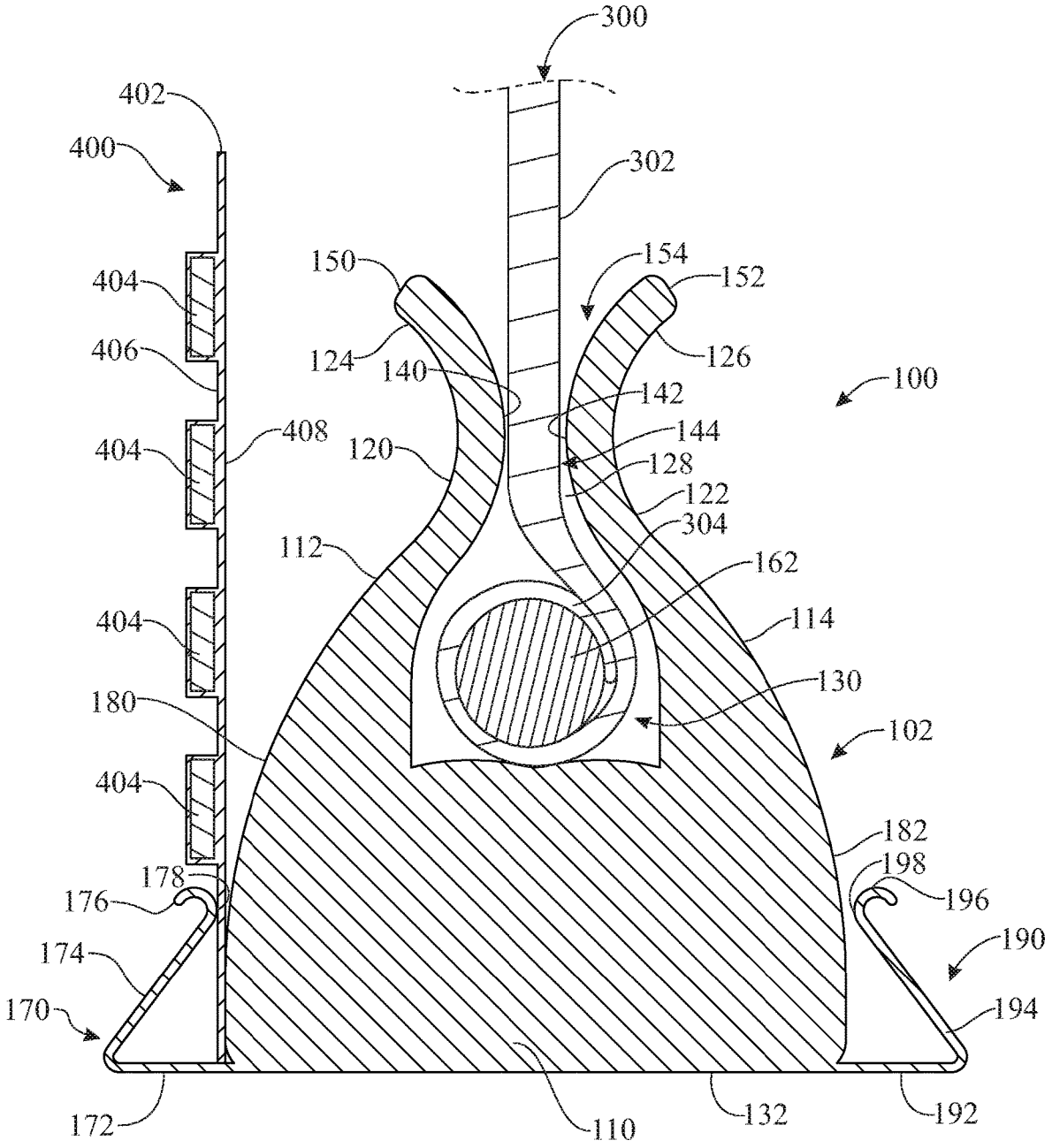
FIG. 5 presents a cross-sectional side elevation view of the assembled combined toothpaste tube and additional item holder of FIG. 4, showing holding the tube of toothpaste and the package of medicine, in accordance with an embodiment of the present invention.

Referring now to FIGS. 3-5, the first medicine clip 170 is provided to hold, retain and visually show a package of medicine. Thus, individuals are reminded to take their medicine when they either, access and use the device 100 to dispense toothpaste for brushing their teeth, or when they physically visit the bathroom or designated area for other purposes but visually see the package of medicine stored in the device 100 as a reminder to take their medication. As shown in FIG. 3, the first medicine clip 170 is provided to retain a first package of medicine 400 having a relatively flat backing 402, and a bubble covering enclosing a plurality of medicine tablets 404 displayed on a front side 406. The package of medicine 400 is removably retained within the medicine clip 170 in which the recurved segment 178 of the clip 170 pushes the package of medicine 400 against the outer surface of the wall 112, as better illustrated in FIG. 4.

Figure 6:
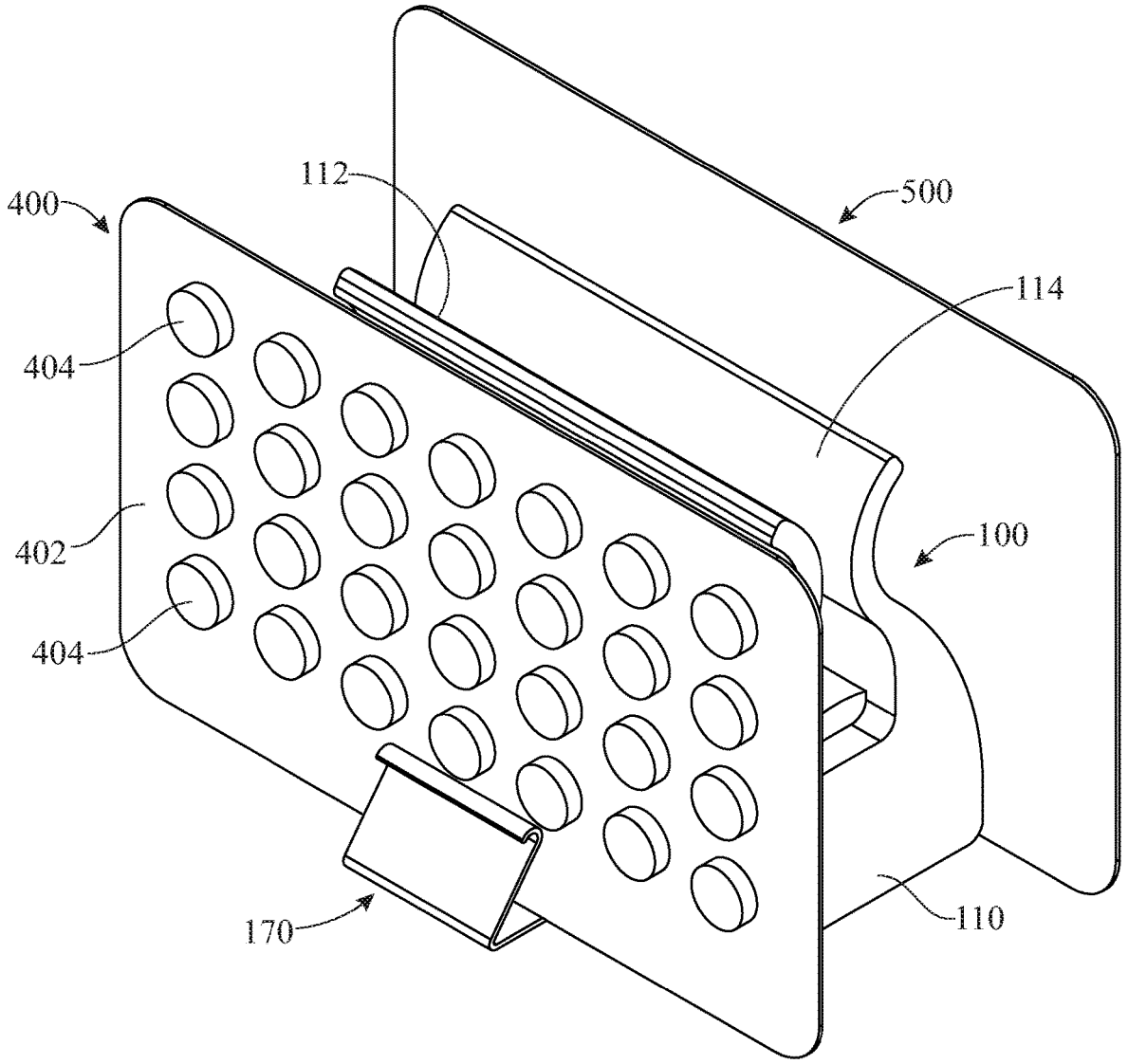
FIG. 6 presents a front, side isometric view of the combined toothpaste tube and additional item holder of FIG. 1, showing a first packet of medicine inserted into a first medicine clip and a second packet of medicine inserted into a second medicine clip of the combined toothpaste tube and additional item holder, in accordance with an embodiment of the present invention.

With specific reference to FIGS. 5 and 6, it can be seen that the combined toothpaste tube and additional item holder 100 may include a second medicine clip 190 located adjacent the second side wall 114 for retaining a second package of medicine 500. The second medicine clip 190 includes a second clip base 192 extending outwardly from the base 110 such as flush with the flat bottom surface 132 of the base 110, and an upwardly extending wall 194 extending upwardly from the second clip base 192 and angling inwardly towards the second wall 114. The upwardly extending wall 194 terminates in a recurved free end 196 curving away from the second wall 114 and a convex inner surface 198 which is configured to pinch or secure a second medicine pack 500 (FIG. 6) against the second side outer surface 182 of the second wall 114. The second medicine pack 500 may be identical to, or differ from, the first medicine pack 400. It is understood that the first base 172 of the first medicine clip 170, and the second base 192 of the second medicine clip 190 may be separately, or integrally formed with, the base 110 of the toothpaste tube and additional item holder 100, as shown in FIG. 5.

Referring now to FIGS. 1-6, the use of the combined toothpaste tube and additional item holder 100 to retain and dispense toothpaste (not shown) from the toothpaste tube 300 and display one or more medicine packs 400 and/or 500 will now be described. Initially, as shown in FIG. 1, the support pad 186 may be positioned on top of the inner top surface 134 of the base 110 and within the channel 130. The bottom end 304 of a tube of toothpaste 300 is wrapped around the shaft 162 of the key 160. The key 160 is rotated to roll a portion of the tube onto the shaft 162. Alternatively, as noted above, the shaft 162 may include a longitudinal slot and the bottom end 304 of the tube of toothpaste 300 may be inserted into the slot and the key 160 rotated to wind the bottom end 304 onto the elongate shaft 162. Rolling a portion of a tube of toothpaste 300 onto the shaft 162 of the key 160 is generally accomplished with the use of both hands.

As shown by the dotted directional arrow in FIG. 2, the key 160 along with the tube of toothpaste 300 is inserted into the combined toothpaste tube and additional item holder 100 such that the key 160 and the closed bottom end 304 of the tube of toothpaste 300 enter the channel 130 and the remainder of the body portion 302 of the tube of toothpaste is captured within the slot 128 between the first and second walls 112 and 114 (FIGS. 2 and 3). As best shown in FIG. 5, the body portion 302 of the tube of toothpaste 300 is positioned and squeezed between the convex inner surfaces 140 and 142 of the first and second arcuate central portions 120, 122 of the first and second side walls 112 and 114, respectively. In this manner, the tube of toothpaste 300 is properly mounted within the combined toothpaste tube and additional item holder 100 and ready for use.

As best shown in FIGS. 3, 4 and 5, the first package of medicine 400 is inserted between the first medicine clip 170 and the first side outer surface 180 of the first wall 112 such that the first package of medicine 400 is secured in spring clip fashion between the first side outer surface 180 of the first wall 112 and the convex inner surface 178 of the upwardly extending wall 174 of the first medicine clip 170. As shown in FIGS. 4 and 5, in one non-limiting embodiment, only an edge portion of the first package of medicine 400 remains inside the first medicine clip 170 while the majority of the first package of medicine 400 remains outside the first medicine clip 170 and visually accessible by an observer. Thus, the first package of medicine 400 is positioned on the combined toothpaste tube and additional item holder 100 in a manner readily observable by the user or operator and functions to remind the user or operator to take the medicine tablet 404 contained within the first package of medicine 400 at the appropriate time.

To take the prescribe medication, users simply remove the first package of medicine 400 from the medicine clip 170 with ease, and replace it within the medicine clip 170 when finished. When ready to dispense toothpaste from the tube of toothpaste, users initially remove the removable cap 306 from the top end 308 of the tube of toothpaste 300 to reveal an opening (not shown) in the top end 308. The user or operator grasps the T-handle 164 of the key 160 and rotates the key 160 to draw the body portion 302 of the tube of toothpaste 300 down between the first and second walls 112 and 114, which in turn applies the necessary pressure needed to eject toothpaste out from the top end 308 of the tube 300. As the body portion 302 is drawn down and passes through the pinch area 144 between the convex inner surfaces 140, 142, the body portion 302 is compressed and thereby squeezes toothpaste out of the opening in the top end 308 of the tube of toothpaste 300. In this manner, the combined toothpaste tube and additional item holder 100 dispenses toothpaste easily and efficiently onto a toothbrush for use. In a different use application, the tube of toothpaste 300 and key 160 can be removed from the slot 128 prior to operating the key 160 to dispense toothpaste from the tube of toothpaste 300. It should also be noted that the order of dispensing the toothpaste and removing the first package of medicine 400 can be reversed or even occur simultaneously.

Turning to FIG. 6, the combined toothpaste tube and additional item holder 100 can be utilized without the need for a tube of toothpaste 300. For example, the first package of medicine 400 can be positioned within the first medicine clip 170, and the second package of medicine 500 can be inserted into the second medicine clip 190 (FIG. 5) for use in display of the second package of medicine 500 and dispensing additional or differing medicines. As such, the holder 100 functions to hold a first package of medicine 400, hold two packages of medicine 400, 500, or hold either or both packages of medicine 400, 500 and a tube of toothpaste 300 providing a novel toothpaste dispensing and medicine display device 100.

It will be understood that various modifications can be made without departing from the scope of the invention. As such, each medicine clip 170, 190 may comprise one or more medicine clips that are each configured for holding a variety of different items including, but not limited to, packages of medicine, instructions, written reminders or notes, paper prescriptions, a toothbrush, a comb, pads, band aids, or other small items or articles. Further, the toothpaste tube and additional item holder 100 may come in a variety of different colors, and include any of designs, patterns, characters, symbols, numbers, letters, logos, or other indicia to enhance the aesthetic appeal or functional character of the device. For example, the holder 100 may comprise a same color as fixtures or other accessories that are commonly used in a bathroom, including for example, a chrome, white, off-white, or ivory color. A series of ridges, grooves, protrusions, or raised nubs may be provided on the outer surface of the walls 112, 114, or on the sides 110, 116 to provide friction holding attributes to prevent the device 100 from slipping in-between or from a user's hands during use. Also a friction material, such as rubber feet or a rubber pad may be provided on the flat bottom surface 132 of the tube holder base 110 to prevent the device 100 from slipping on a horizontal surface.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A combined toothpaste tube and item holder comprising:

a body including a tube holder base having a planar bottom surface, a first sidewall and a second sidewall each integrally joined to and extending upwards from opposite sides of said base forming a channel including a planar channel surface extending an entire length of said channel opposite said planar bottom surface and a slot in communication with said channel, each sidewall including a top end flaring outwards away from each other defining a convex formation, each convex formation extending towards each other within said slot forming tube compression members;

a key having a handle attached to a shaft readily rotated to wind a closed end of a collapsible tube, said key removably inserted within said channel with said shaft resting on said planar channel surface in parallel with said slot;

a first spring clip including a first spring clip base having a first end attached to and coplanar with said planar bottom surface of said tube holder base and extending outwardly from and perpendicular to a first sidewall of said tube holder base and a second end conjoined to a first spring clip wall, said first spring clip wall extending upwards at an incline from said second end of said first spring clip base towards an outer surface of said first sidewall and terminating at a top wall edge, said top wall edge of said first spring clip displaced adjacent said outer surface of said first sidewall for removably holding and displaying an item between said top wall edge of said first spring clip and said outer surface of said first sidewall; and a second spring clip including a second spring clip base having a first end attached to and coplanar with said planar bottom surface of said tube holder base and extending outwardly from and perpendicular to a second and opposite sidewall of said tube holder base and a second end conjoined to a second spring clip wall, said second spring clip wall extending upwards at an incline from said second end of said second spring clip base towards an outer surface of said second sidewall and terminating at a top wall edge, said top wall edge of said second spring clip displaced adjacent said outer surface of said second sidewall for removably holding and displaying an item between said top wall edge of said second spring clip and said outer surface of said second sidewall.

2. The combined toothpaste tube and item holder of claim 1, wherein said first sidewall includes an outer arcuate surface beginning along a bottom edge of said tube holder base and terminating at a concave formation, and wherein said second sidewall includes an outer arcuate surface beginning along another bottom edge of said tube holder and terminating at a concave formation, said concave formations opposite said convex formations.

3. The combined toothpaste tube and item holder of claim 2, wherein said planar bottom surface is wider than said planar channel surface.

4. The combined toothpaste tube and item holder of claim 3, wherein said tube compression members are spaced apart from each other a predetermined distance and are situated above said channel.

5. The combined toothpaste tube and item holder of claim 4, wherein each sidewall resiliently flexes outwards away from each other greater than said predetermined distance when said collapsible tube is disposed between said tube compression members.

6. The combined toothpaste tube and item holder of claim 5, wherein said slot, said channel, and said tube compression members extend the length of said tube holder base.

7. The combined toothpaste tube and item holder of claim 6, wherein said handle is perpendicular to said shaft and includes an outer handle surface engaging with outer side edges of each sidewall when said shaft is removably disposed within said channel.

8. The combined toothpaste tube and item holder of claim 7, wherein said shaft includes an elongate slot receiving said closed end of said collapsible tube therein.

9. The combined toothpaste tube and item holder of claim 6, wherein said tube holder base is configured to retain said collapsible tube at rest in a vertical position on a horizontal surface when said collapsible tube is disposed within said slot between said tube compression members.

10. The combined toothpaste tube and item holder of claim 1, wherein each of said first spring clip wall of said first spring clip and said second spring clip wall of said second spring clip resiliently flexes outwards from said first sidewall and said second sidewall, respectively.

11. The combined toothpaste tube and item holder of claim 10, wherein said first spring clip and said second spring clip are attached about a central region of said tube holder base on opposite sides thereof.

12. The combined toothpaste tube and item holder of claim 11, wherein said top wall edges of each of said first spring clip and said second spring clip bends outwards away from each said outer surface of said first sidewall and said second sidewall, respectively, forming a curved top edge.

13. The combined toothpaste tube and item holder of claim 1, further including a support pad disposed on said planar channel surface within said channel.

14. The combined toothpaste tube and item holder of claim 13, wherein said shaft of said key is removably disposed on said support pad within said channel.

15. The combined toothpaste tube and item holder of claim 14, wherein said support pad extends a portion of a length of said planar channel surface.

16. The combined toothpaste tube and item holder of claim 15, wherein said support pad prevents said shaft from rotating freely within said channel when a portion of said closed end of said collapsible tube is wound around said shaft when said handle remains at rest in a nonoperative state.

17. A combined toothpaste tube and item holder comprising:

a body including a tube holder base having a planar bottom surface, a first sidewall and a second sidewall each integrally joined to and extending upwards from opposite sides of said base forming a channel including a planar channel surface opposite said planar bottom surface and a slot in communication with said channel, each sidewall including a top end flaring outwards defining a concave formation and a convex formation opposite said concave formation, each convex formation extending towards each other within said slot forming tube compression members, and an outer arcuate surface beginning along an edge of said tube holder base and terminating at said concave formation;

a key having a handle attached to a shaft readily rotated to wind a closed end of a collapsible tube, said key removably inserted within said channel with said shaft resting on said planar channel surface in parallel with said slot;

a first spring clip including a first spring clip base having a first end attached to a first sidewall of said tube holder base and a second end conjoined to a first spring clip wall, said first spring clip wall extending upwards at an incline from said second end of said first spring clip base towards an outer surface of said first sidewall and terminating at a top wall edge, said first end of said first spring clip base integrally attached to said tube holder base and extending outwards from and perpendicular with said first sidewall of said tube holder base such that an outer bottom surface of said first spring clip base is coplanar with said planar bottom surface of said tube holder base, said top wall edge of said first spring clip adjacent said outer surface of said first sidewall for removably holding and displaying en-item a first package of medicine between said top w edge of said first spring clip and said outer surface of said first sidewall; and a second spring clip including a second spring clip base having a first end attached to a second and opposite sidewall of said tube holder base and a second end conjoined to a second spring clip wall, said second spring clip wall extending upwards at an incline from said second end of said second spring clip base towards an outer surface of said second sidewall and terminating at a top wall edge, said first end of said second spring clip base integrally attached to said tube holder base and extending outwards from and perpendicular with said second and opposite sidewall of said tube holder base such that an outer bottom surface of said second spring clip base is coplanar with said planar bottom surface of said tube holder base, said top wall edge of said second spring clip adjacent said outer surface of said second sidewall for removably holding and displaying a second package of medicine between said top wall edge of said second spring clip and said outer surface of said second sidewall.

18. A combined toothpaste tube and item holder comprising:

a body including a tube holder base having a planar bottom surface, a first sidewall and a second sidewall each integrally joined to and extending upwards from opposite sides of said base forming a channel including a planar channel surface opposite said planar bottom surface and a slot in communication with said channel, each sidewall including a top end flaring outwards defining a concave formation and a convex formation opposite said concave formation, each convex formation extending towards each other within said slot forming tube compression members, and an outer arcuate surface beginning along an edge of said tube holder base and terminating at said concave formation;

a key having a handle attached to a shaft readily rotated to wind a closed end of a collapsible tube, said key removably inserted within said channel with said shaft resting on said planar channel surface in parallel with said slot;

a first spring clip including a first spring clip base having a first end attached to a first sidewall of said tube holder base and a second end conjoined to a first spring clip wall, said first spring clip wall extending upwards at an incline from said second end of said first spring clip base towards an outer surface of said first sidewall and terminating at a top wall edge, said first end of said first spring clip base integrally attached to said tube holder base and extending outwards from and perpendicular to said first sidewall of said tube holder base such that an outer bottom surface of said first spring clip base is coplanar with said planar bottom surface of said tube holder base, said top wall edge of said first spring clip adjacent said outer surface of said first sidewall for removably holding and displaying a first package of medicine between said top edge and said outer surface of said first sidewall;

a second spring clip including a second spring clip base having a first end attached to a second and opposite sidewall of said tube holder base and a second end conjoined to a second spring clip wall, said second spring clip wall extending upwards at an incline from said second end of said second spring clip base towards an outer surface of said second sidewall and terminating at a top wall edge, said first end of said second spring clip base integrally attached to said tube holder base and extending outwards from and perpendicular to said second and opposite sidewall of said tube holder base such that an outer bottom surface of said second spring clip base is coplanar with said planar bottom surface of said tube holder base, said top wall edge of said second spring clip adjacent said outer surface of said second sidewall for removably holding and displaying a second package of medicine between said top wall edge of said second spring clip and said outer surface of said second sidewall; and a support pad disposed on said planar channel surface within said channel.

* * * * *